United States Patent [19]

Fujii

[11] Patent Number: 4,687,315

[45] Date of Patent: Aug. 18, 1987

[54] TEMPERATURE CONTROLLER WITH SHAPE MEMORY ALLOY IN A FIXING DEVICE OF ELECTROPHOTOGRAPHIC COPYING MACHINE

[75] Inventor: Yoshihalu Fujii, Sakurai, Japan

[73] Assignee: Sharp Kabushiki Kaisha, Osaka, Japan

[21] Appl. No.: 550,569

[22] Filed: Nov. 10, 1983

[30] Foreign Application Priority Data

Nov. 12, 1982 [JP] Japan ..... 57-199543

[51] Int. Cl.[4] ..... G03G 21/00

[52] U.S. Cl. ..... 355/3 FU; 355/14 FU

[58] Field of Search ..... 355/14 FU, 3 FU; 219/216, 469, 470, 471; 337/140

[56] References Cited

U.S. PATENT DOCUMENTS

| | | | |
|---|---|---|---|
| 3,465,122 | 9/1964 | Kolless | 219/469 |
| 3,469,077 | 9/1964 | Petersen et al. | 219/469 |
| 3,594,674 | 7/1971 | Witlson | 337/140 |
| 3,881,085 | 4/1975 | Traister | 355/3 FU |
| 4,385,826 | 5/1983 | Itoh | 355/14 FU |

FOREIGN PATENT DOCUMENTS

| | | | |
|---|---|---|---|
| 0675473 | 7/1979 | U.S.S.R. | 337/140 |

*Primary Examiner*—A. T. Grimley
*Assistant Examiner*—David Warren
*Attorney, Agent, or Firm*—Birch, Stewart, Kolasch & Birch

[57] ABSTRACT

An electrophotographic copying machine comprises a device for controlling the temperature of a heating roller which presses a copy paper carrying a toner image thereon together with a fixing roller. The device comprises a switch and an actuator. The actuator comprises a shape memory alloy spring, an ordinary spring, a washer, and a shaft. The shaft is pressed in accordance with the movement of the washer. The washer moves according to the force balance between the shape memory alloy spring and the ordinary spring as the temperature of the heating roller varies.

3 Claims, 4 Drawing Figures

TEMPERATURE CONTROLLER WITH SHAPE MEMORY ALLOY IN A FIXING DEVICE OF ELECTROPHOTOGRAPHIC COPYING MACHINE

BACKGROUND OF THE INVENTION

The present invention relates to a temperature controller of an electrophotographic copying machine and, more particulary, to a temperature controller for a fixing device in an electrophotographic copying machine.

An electrophotographic copying machine produces an electrostatic latent image on an optical-sensitive member with an optical system. The latent image corresponds to an image on a copy document such as a manuscript or book to be copied. Toner particles are electrically adhered to the latent image, so that the latent image becomes visible to form a toner image. The toner image is transferred onto a copy paper via a transference charger. The toner image on the copy paper is pressed and fixed by a fixing device.

Conventionally, the fixing device comprises a pair of rollers for pressing the toner image onto the copy paper. At least one of the pair of rollers is heated with a halogen lamp to a toner fixable temperature. Conventionally, the halogen lamp is controlled to be heated in response to ON/OFF signals from a controller which responds to a thermistor for monitoring the temperature of the surface of the roller to be heated.

However, the above conventional system is rather complicated and costly, so that it is desired to provide an improved device.

SUMMARY OF THE INVENTION

Accordingly, it is an object of the present invention to provide an improved device for controlling the temperature of a surface of at least one of a pair of fixing rollers in a copying machine.

It is another object of the present invention to provide an improved electrophotographic copying machine comprising a device for controlling the temperature of at least one of a pair of fixing rollers in a fixing device.

Briefly described, in accordance with the present invention, an electrophotographic copying machine comprises a device for controlling the temperature of at least one of a pair of fixing rollers for pressing a toner image onto a copy paper. The device comprises a switch and an actuator. The actuator comprises a shape memory alloy spring, an ordinary spring, a washer, and a shaft. The switch permits at least one of the fixing rollers to be heated to a toner image fixable temperature. Above the toner image fixable temperature, the switch is disconnected and the fixing roller is no longer heated.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

Figure 1:
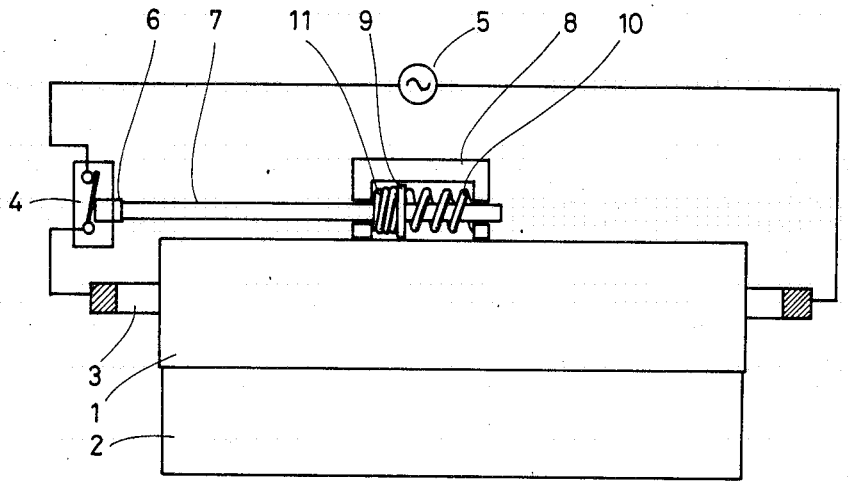
FIG. 1 shows a schematic view of a fixing device comprising a switch and an actuator in an electrophotographic copying machine according to the present invention, the actuator comprising a shape memory alloy spring, an ordinary spring, a washer, and a shaft.

FIG. 1 shows a schematic view of a fixing device in an electrophotographic copying machine of the present invention.

Referring to FIG. 1, the fixing device comprises a heating roller 1, a pressing roller 2, a halogen lamp 3, a switch 4, a power source 5, a push button 6, a shaft 7, a box 8, a washer 9, a coil spring 10, and a shape memory alloy coil spring 11.

Since the halogen lamp 3 is installed within the heating roller 1, the heating roller 1 is heated by the halogen lamp 3 up to a toner image fixable temperature, conventionally about 150–200 degrees Centigrade. The pressing roller 2 is pressed toward the heating roller 1 to grasp a transferred copy paper carrying a toner image thereon and press the toner image onto the copy paper. The switch 4 functions to interrupt power energy from the power source to the lamp 3. The switch 4 becomes conductive in response to the pushing of the push button 6, so that the lamp 3 is powered by the power source 5 and heated. It becomes nonconductive in response to the release of the pushing of the push button 6, so that the lamp 3 is not powered by the power source 5 and not heated.

Figure 2A:
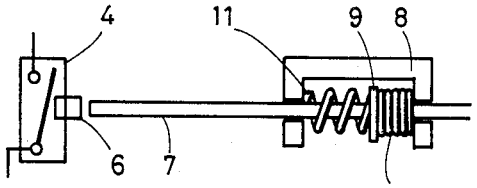
FIGS. 2(A) and 2(B) show schematic views of the switch and the actuator of FIG. 1.
Figure 2B:
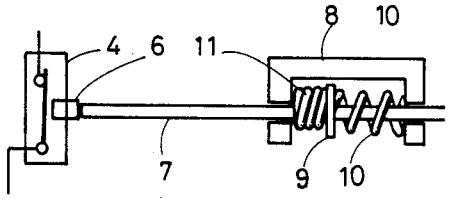

Referring to FIGS. 2(A) and 2(B), the shaft 7 confronts the push button 6. The shaft 7 can be reciprocated in response to the pressure balance on the washer 9. The end of the shaft 7 reaches the washer 9 positioned inside the box 8. The box 8 may be positioned near or in contact with the heating roller 1. The washer 9 is sandwiched by the spring 10 and the shape memory alloy spring 11 both installed within the box 8.

The spring 10 can serve to force the shaft 7 in the left direction via the washer 9, so that the shaft 7 pushes the push button 6 at the tip of the shaft 7 in order to close the switch 4. Against the push force by the spring 10, the shape memory alloy coil spring 11 can serve to expand the distance between the washer 9 and the box wall since the spring 11 made of a shape memory alloy is positioned between the washer 9 and the box wall.

The shape memory alloy per se is well known as disclosed in U.S. Pat. No. 3,403,238, issued on Sept. 24, 1968, entitled "CONVERSION OF HEAT ENERGY TO MECHANICAL ENERGY". The disclosure of this patent is incorporated herein by reference.

The shape memory alloy undergoes a martensitic transition dependent on the temperature. The maximum temperature at which this transition can occur is called a critical temperature and this temperature is a function of the alloy composition.

According to the nature of the shape memory alloy, the shape memory alloy spring 11 can freely shrink at room temperature in response to the force of the spring 10. When it is heated above the critical temperature, it is necessarily deformed to a memorized coil shape. The memory effect of the shape memory alloy spring 11 is such that, above the critical temperature, the spring 11 should expand. The critical temperature is selected to be substantially equal to a temperature of the heating roller 1 above which the toner image can be fixed onto the copy paper. Above the critical temperature, the shape memory alloy spring 11 expands to the memorized shape, so that the spring 10 shrinks, to thereby move the washer 9 toward the right side of the box 8. This is because the spring 10 and the shape memory alloy spring 11 are selected so that, at room temperature, the spring 10 presses the spring 11 to shrink the spring 11 and, above the critical temperature, the shape memory alloy spring 11 presses the spring 10 to shrink the spring 10.

At room temperature, the spring 10 forces the shape memory alloy spring 11 to shrink, so that the shaft 7 moves leftward via the washer 9. Therefore, as FIG. 1 shows, the push button 6 presses the switch 4 to close it. When the power switch 4 is in a conductive state, the power from the power source 5 is transmitted to the lamp 3, so that the heating roller 1 is gradually heated. As the temperature of the heating roller 1 rises, the temperature of the shape memory alloy spring 11 also rises via the box 8 since the box 8 is near or in contact with the heating roller 1.

Finally, when the temperature of the heating roller 1 is heated above the toner image fixable temperature substantially equal to the critical temperature, the shape memory alloy spring 11 is heated also above the critical temperature, so that the spring 11 is permitted to be deformed to the memorized shape, namely, to extend. As FIG. 2(A) shows, the shape memory alloy spring 11 presses the spring 10 to shrink the spring 10, so that the shaft 7 moves rightward via the washer 9. The tip of the shaft 7 is separated from the push button 6. The switch 4 opens and the circuit becomes nonconductive, so that the lamp 3 is prevented from being heated.

While the lamp 3 is prevented from being heated, the heating roller 1 is cooled. Finally, below the critical temperature, the shape memory alloy spring 11 can be compressed by the force of the spring 10, so that the washer 9 moves leftward to therby push the push button 6 with the shaft 7 as shown in FIG. 2(B). The switch 4 becomes closed and the circuit to energize the lamp 3 with the power source 5.

Thus, the temperature of the heating roller 1 can be controlled by the reciprocation of the shaft 7 according to the feature of the shape memory alloy spring 11.

Figure 3:
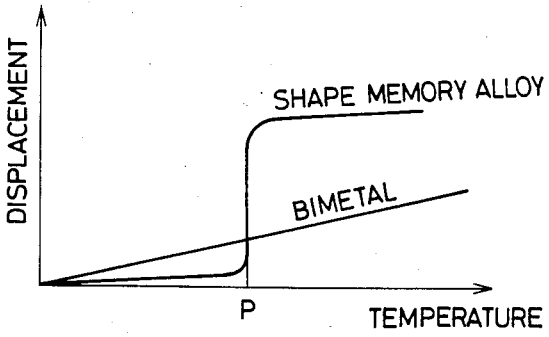
FIG. 3 shows a graph representative of the relation between displacement and temperature in the shape memory alloy and a bimetal.

FIG. 3 shows a graph representative of the difference between the shape memory alloy and a bimetal. The shape memory alloy is superior to the bimetal in that the displacement of the shape memory alloy is more remarkable than the bimetal at the critical temperature P.

It may be possible that in place of the shape memory alloy coil spring 11, the contacts of the switch 4 are made of the shape memory alloy the control the heat the lamp 3.

While only certain embodiments of the present invention have been described, it will be apparent to those skilled in the art that various changes and modifications may be made therein without departing from the spirit and scope the present invention as claimed.

What is claimed is:

1. A temperature control system for fixing a toner image in an electrophotographic copying machine comprising:

a pair of fixing rollers provided for fixing a toner image onto a copy paper;

heating means for heating at least one of said fixing rollers to a critical temperature for fixing said toner image; and a temperature sensitive device for controlling activation of said heating means comprising a shape memory alloy spring, a conventional spring, and a washer sandwiched between said shape memory alloy spring and said conventional spring said temperature sensitive device being juxtapositioned to said at least one heated fixing roller;

said shape memory alloy spring expanding when said fixing roller is heated to a temperature above said critical temperature so as to interrupt power to said heating means and contracting when temperature of said fixing roller drops below said critical temperature to restore said power to said heating means.

2. The temperature control system of claim 1, further comprising a switch means triggered by said temperature sensitive device to permit power to flow from a power source to said heating means.

3. The temperature control system of claim 2, further including a shaft means forced by said washer means in response to expansion and contraction of said shape memory alloy spring and said conventional spring means so as to open and close said switch means.

* * * * *